US009127216B2

(12) United States Patent
Govindhakannan et al.

(10) Patent No.: US 9,127,216 B2
(45) Date of Patent: Sep. 8, 2015

(54) PROCESS AND APPARATUS FOR RECYCLING A DEASHED PITCH

(71) Applicant: UOP, LLC, Des Plaines, IL (US)

(72) Inventors: Jagannathan Govindhakannan, Des Plaines, IL (US); Grant Yokomizo, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 305 days.

(21) Appl. No.: 13/888,978

(22) Filed: May 7, 2013

(65) Prior Publication Data

US 2014/0332442 A1 Nov. 13, 2014

(51) Int. Cl.
*C10C 3/08* (2006.01)
*C10G 47/26* (2006.01)

(52) U.S. Cl.
CPC ..... *C10G 47/26* (2013.01)

(58) Field of Classification Search
CPC ..... C10C 3/08; B01J 2219/00006
See application file for complete search history.

(56) References Cited

U.S. PATENT DOCUMENTS

| | | | |
|---|---|---|---|
| 3,475,318 | A | 10/1969 | Gable at al. |
| 4,430,197 | A | 2/1984 | Poynor et al. |
| 8,197,668 | B2 | 6/2012 | Ou et al. |
| 2008/0156700 | A1 | 7/2008 | Abulnaga et al. |
| 2010/0248946 | A1 | 9/2010 | Bauer et al. |
| 2011/0303580 | A1 | 12/2011 | Haizmann |

FOREIGN PATENT DOCUMENTS

| | | |
|---|---|---|
| WO | 9836036 | 8/1998 |
| WO | 9964540 | 12/1999 |
| WO | 2010142397 | 12/2010 |

OTHER PUBLICATIONS

Griffith et al., "Solvent Extraction of Bituminous Coals Using Light Cycle Oil: Characterization of Diaromatic Products in Liquids", Energy and Fuels, Sep. 2009, vol. 23, No. 9, pp. 4553-4561.

*Primary Examiner* — Randy Boyer
(74) *Attorney, Agent, or Firm* — James C. Paschall

(57) ABSTRACT

One exemplary embodiment can be a process for recycling a deashed pitch to a slurry hydrocracking zone. The process may include adding a solvent to a neat pitch to obtain a mixture, separating a supernate and a precipitate from the mixture, segregating the solvent from the supernate, and recycling the deashed pitch from the supernate to the slurry hydrocracking zone.

20 Claims, 1 Drawing Sheet

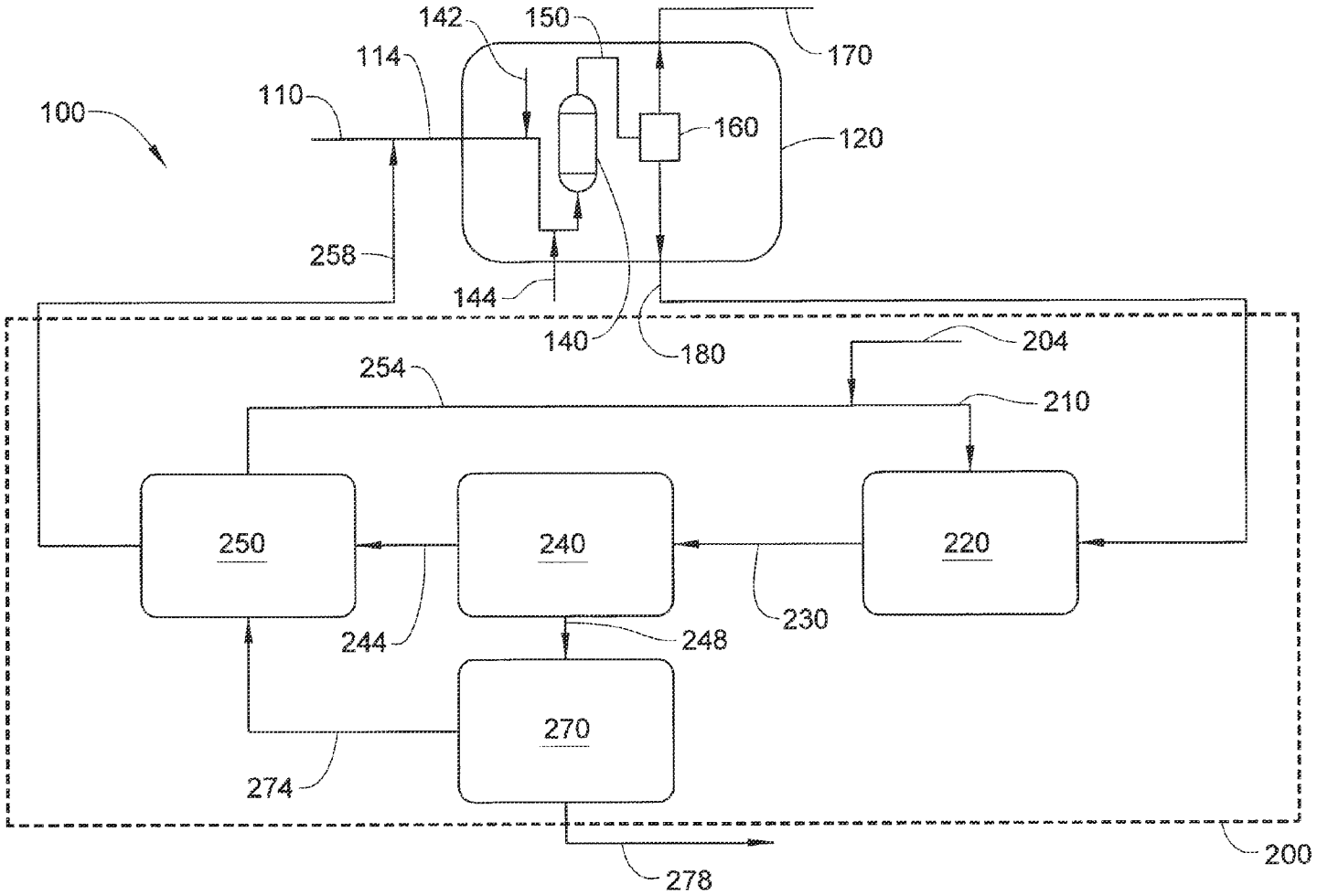
100
110
114
142
150
170
160
120
258
144
140
180
254
204
210
220
230
240
244
250
248
270
274
278
200

PROCESS AND APPARATUS FOR RECYCLING A DEASHED PITCH

FIELD OF THE INVENTION

This invention generally relates to a process and an apparatus for recycling a deashed pitch.

DESCRIPTION OF THE RELATED ART

Generally, an unconverted feed recycle is a conventional methodology to increase conversion. However, in slurry hydrocracking of vacuum resid feedstocks the pitch fraction may have an unacceptably high concentration of organic, such as isotropic and anisotropic solids, and inorganic, such as nickel and vanadium compounds, contaminants that can cause coking and plugging issues. However, there often is a pitch fraction including organic compounds mixed with the contaminants that would increase yields if recyclable. Therefore, there is a desire to recover these organic compounds from the pitch fraction.

SUMMARY OF THE INVENTION

One exemplary embodiment can be a process for recycling a deashed pitch to a slurry hydrocracking zone. The process may include adding a solvent to a neat pitch to obtain a mixture, separating a supernate and a precipitate from the mixture, segregating the solvent from the supernate, and recycling the deashed pitch from the supernate to the slurry hydrocracking zone.

Another exemplary embodiment may be a process for recycling a deashed pitch to a slurry hydrocracking zone. The process can include passing a feed to a slurry hydrocracking reactor, obtaining a neat pitch from the slurry hydrocracking reactor, sending the neat pitch to a mixing tank, adding a solvent to the neat pitch to form a mixture, passing the mixture to a centrifuge, separating the deashed pitch, passing the separated deashed pitch to a fractionator to segregate a solvent, and passing the deashed pitch from the fractionator to the feed.

A further exemplary embodiment can be an apparatus for recycling a deashed pitch. The apparatus may include a slurry hydrocracking reactor, a mixing tank in communication with the slurry hydrocracking reactor to receive a neat pitch, a centrifuge in communication with the mixing tank to receive a mixture from the mixing tank, and a fractionator in communication with the centrifuge to receive a supernate separated from a precipitate. Generally, the fractionator is in communication with the slurry hydrocracking reactor to provide the deashed pitch from the fractionator.

The embodiments disclosed herein can recycle a deashed pitch fraction that may have a much lower concentration of organic and inorganic contaminants as compared to recycling of the neat pitch itself. Generally, recycling of the dashed pitch improves the solubility of mesophase precursors in bulk liquid phase in the reactor and thus helps to achieve higher conversion than that of the operation with neat pitch recycle. Moreover, such recycling can improve product yields.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^+$ or $C3^-$, which is inclusive of the abbreviated one or more hydrocarbons. As an example, the abbreviation "$C3^+$" means one or more hydrocarbon molecules of three carbon atoms and/or more. A "stream" may also be substances, e.g., fluids or solids flowing as fluids. An exemplary fluid, other than hydrocarbons, can be hydrogen.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally about 50%, and preferably about 70%, by mole, of a compound or class of compounds in a stream.

As used herein, the term "pitch" can mean a hydrocarbon material boiling above about 524° C. and can include one or more $C25^+$ hydrocarbons. Typically, a pitch is an effluent from a slurry hydrocracking reactor.

As used herein, the term "a vacuum bottom" can mean a hydrocarbon material boiling above about 524° C. and can include one or more $C25^+$ hydrocarbons. Often, a vacuum bottom may be a feed to a slurry hydrocracking reactor.

As used herein, the term "neat pitch" can refer to a pitch produced by a slurry hydrocracking reactor that typically has yet to be modified.

As used herein, the term "g-force" can be a ratio of product of square of angular velocity and radius divided by a gravitional constant, g. The formula can be expressed:

$$g\text{-force}=Z=r\omega^2/g$$

As used herein, the term "hour" may be abbreviated "hr", the term "kilogram" may be abbreviated "kg", the term "kilopascal" may be abbreviated "KPa", the term "megapascal" may be abbreviated "MPa", and the terms "degrees Celsius" may be abbreviated "° C.". All pressures are absolute.

As depicted, the process flow lines in the FIGURE can be referred to interchangeably as, e.g., lines, pipes, feeds, branches, oils, portions, products, or streams.

BRIEF DESCRIPTION OF THE DRAWING

The FIGURE is a schematic depiction of an exemplary apparatus.

DETAILED DESCRIPTION

An apparatus 100 can include a slurry hydrocracking zone 120 and a pitch deashing zone 200. The slurry hydrocracking zone 120 can include a slurry hydrocracking reactor 140 and a separation zone 160.

A feed 110 including one or more hydrocarbons may include or consist of at least one of a heavy oil vacuum bottom, a vacuum residue, a fluid catalytic cracking slurry oil or other heavy hydrocarbon-derived oils. Alternatively, the feed 110 can be at least one of a coal liquid or a biofuel feedstock such as lignin, one or more plant parts, one or more fruits, one or more vegetables, a plant processing waste, one or more woodchips, chaff, one or more grains, one or more grasses, a corn, one or more corn husks, one or more weeds, one or more aquatic plants, hay, paper, and any cellulose-containing biological material. The feed 110 can be combined with a separated hydrocarbon or a deashed pitch stream 258 including one or more $C25^+$ hydrocarbons, which is described in further detail hereinafter, to form a combined feed 114, which can be provided to the slurry hydrocracking zone 120.

The combined feed 114 can be combined with a slurry hydrocracking catalyst provided by a line 142. Often, the slurry hydrocracking catalyst includes solids, which can, in turn, include at least one of molybdenum sulfide, nickel sulfide, an iron oxide, an iron sulfate, an iron carbonate, iron sulfate monohydrate, and an iron sulfate heptahydrate. Typically, the catalyst particles can have, independently, a diameter of no more than about 100 microns. Exemplary slurry hydrocracking catalyst is disclosed in, e.g., US 2011/0303580.

Hydrogen may be provided by a line 144 before entering the slurry hydrocracking reactor 140 in the slurry hydrocracking zone 120. Generally, the hydrogen in the line 144 can include recycled and/or make-up hydrogen, and as such can include other light hydrocarbon molecules, such as methane and ethane. Typically, the stream contained in the line 144 can be rich in hydrogen.

The slurry hydrocracking reactor 140 can operate at any suitable conditions, such as a temperature of about 340-about 600° C., a hydrogen partial pressure of about 3.5-about 10.5 MPa, and a space velocity of about 0.1-about 30 volumes of the combined feed 114 per hour per slurry hydrocracking reactor volume. If an iron sulfate monohydrate ($FeSO_4.H_2O$) is utilized, heating the catalyst may lose a water molecule to become iron sulfate ($FeSO_4$). Under the presence of hydrogen and hydrogen sulfide, the iron sulfate can transform to iron sulfide (FeS), and further may transform to $Fe_{1-x}S$ where x is less than 1. The catalyst can pass from the slurry hydrocracking reactor 140 in a slurry hydrocracking reactor effluent 150.

The slurry hydrocracking reactor effluent 150, including a mixture of fluids, such as gases and liquids, can be provided to a separation zone 160, which can include one or more separation drums and one or more fractionation columns. The one or more fractionation columns can include least one of an atmospheric column and a vacuum distillation column. In one exemplary embodiment, a vacuum distillation column may be used. In such an instance, the vacuum fractionation column can be operated at a pressure of about 1-about 10 KPa, and provide a product stream 170, which can include light vacuum gas oil. Other products can be provided as side streams, such as a heavy vacuum gas oil. An exemplary separation zone is disclosed in, e.g., US 2011/0303580. A bottom stream 180, which can be a neat pitch stream 180, may include a pitch or a vacuum residue and at least partially or fully consumed slurry hydrocracking catalyst. The slurry hydrocracking catalyst passed through the slurry hydrocracking reactor 140 may include iron sulfide, including several structures such as pyrrhotite ($Fe_{11}S_{12}$), pyrrhotite-4H and pyrrhotite-6T ($Fe_{1-x}S$ where x is less than 1, and can have the formula $Fe_{0.88}S$), troilite (FeS), and pyrrhotite-3T ($Fe_7S_8$). Typically, the neat pitch stream 180 can include about 5-about 40%, by weight, one or more solids of at least partially spent catalytic particles.

The neat pitch stream 180 may be provided to the pitch deashing zone 200. Usually, the pitch deashing zone 200 includes a mixing tank 220, a centrifuge 240, a fractionator 250, and a dryer 270. The mixing tank 220 can include one or more mixing tanks that may receive the neat pitch stream 180 and a solvent stream.

A solvent comprised in a solvent stream can dilute the neat pitch comprised in the neat pitch stream 180 for reducing the viscosity of the neat pitch. Thus, the solvent may be a viscosity reducing agent. The solvent can include at least one of a light cycle oil, a heavy reformate, toluene, benzene, and one or more same or different xylenes can be used. Often, a solvent to neat pitch mass ratio is about 3:1-about 1:3, preferably about 2:1-about 1:2. Typically, the light cycle oil can have a UOP Characterization Factor or UOP K of 10.132 and the heavy reformate can have a UOP K of 10.438. UOP K can be indicative of the general origin and nature of a petroleum stock and can be determined per UOP 375-07. Although not wanting to be bound by theory, adding a solvent typically dissolves as much pitch as possible by reducing precipitation to recover and/or extract as much hydrocarbon as possible from the pitch. The mixing can occur for a suitable time for separating hydrocarbons from the catalyst.

A mixture 230 from the mixing tank 220 may be provided to a centrifuge 240, which can provide a supernate 244 and a precipitate 248 including one or more liquids and solids. Often, the centrifuge 240 can include one or more centrifuges and preferably the centrifuge 240 is a decanter centrifuge. The centrifuge 240 may be operated at about 2,000-about 3,500 g to separate the mixture into two phases, namely a supernate 244 and a precipitate 248. Generally, the centrifuge 240 separates the insoluble material, such as a precipitate, from the soluble material, such as a supernate.

The precipitate including solids and some liquid can be provided to the dryer 270, which can include a rotary kiln, an indirect fired kiln, an indirect fired rotary kiln, an indirect fired dryer, an indirect fired rotary dryer, an indirect or direct rotary drum dryer, a fluidized bed dryer, a ring dryer, a paddle dryer, a spray dryer, a flash dryer, a vacuum dryer, and/or a flexicoker, preferably an indirect fired rotary kiln. The atmosphere in the drying device is inert, which is preferably an oxygen-free nitrogen atmosphere but may be any other inert non-oxidizing atmosphere or under vacuum. Drying may occur at a temperature of about 350-about 550° C., which temperature may be maintained for a sufficient residence time to produce a solid material and a residual solvent stream 274 sent to the fractionator 250. Dried solids may be obtained and passed in a line 278 for disposal or further processing recovery of one or more metals. Exemplary mixing tank, centrifuge, fractionator, and dryer are disclosed in, e.g., US 2008/0156700.

The fractionator 250 can receive the supernate 244 and the residual solvent stream 274 to produce a recovered or recycled stream 254 that may receive a make-up solvent stream 204 to form the solvent stream 210. The solvent stream 210 can be provided to the mixing tank 220. The separated hydrocarbon or deashed pitch stream 258 may also be recovered and combined with the feed 110 or slurry hydrocracking zone 120, as described above.

The embodiments disclosed herein can provide a deashed pitch sample with much lower concentration of contaminants as compared to that of a neat pitch. Recycling the deashed pitch can improve solubility as well as to facilitate the transportation of solids in the slurry hydrocracking reactor 140. Although not wanting to be bound by theory, improved solubility can also facilitate a much higher conversion and tighter mesophase control.

Moreover, the embodiments disclosed herein can lessen disposal of solids. Generally, a deashed pitch can be provided having reduced amounts of metals or other components that facilitate slurry hydrocarbon reactions. The deashed pitch can have a carbon content of at least about 79%, preferably about 79-about 90%, and optimally about 86-about 90%, by weight;

a hydrogen content of at least about 6%, preferably about 6-about 9%, and optimally about 7-about 9%, by weight; and a nitrogen content of at least about 0.8%, preferably about 0.8-about 1.5%, and optimally about 0.9-about 1.2%, by weight, as determined by ASTM D5291-09. The hydrogen: carbon atomic ratio of the deashed pitch may be at least about 0.9:1, preferably about 0.9:1-about 1.3:1, and optimally about 0.9:1-about 1.2:1 as calculated. Desirably, the deashed pitch has a sulfur content of no more than about 7%, preferably about 5%, and optimally about 3%, by weight, as determined by UOP 864-12; an iron content of no more than about 7%, preferably about 1%, and optimally about 0.1%, by weight; a nickel content of no more than about 0.04%, preferably about 0.02%, and optimally about 0.01%, by weight; and a vanadium content of no more than about 0.1%, preferably about 0.05%, and optimally about 0.02%, by weight, as determined by UOP 389-10 inductively coupled plasma mass spectrometry. The deashed pitch may also have an ash content of no more than about 10%, preferably about 1%, and optimally about 0.1%, by weight as determined by ASTM D482-12. Furthermore, the deashed pitch may have less than about 30%, preferably about 20%, and optimally about 15%, by weight, of components insoluble in toluene as determined by UOP 614M-02 and can have an amount of carbon residue of no more than about 75%, preferably about 60%, and optimally about 50%, by weight, as determined by ASTM D4530-11. Usually, the carbon residue can result in coking in the slurry hydrocracking zone, particularly in the reactor and heat exchangers.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for recycling a deashed pitch to a slurry hydrocracking zone, comprising:

A) adding a solvent to a neat pitch to obtain a mixture;

B) separating a supernate and a precipitate from the mixture;

C) segregating the solvent from the supernate; and

D) recycling the deashed pitch from the supernate to the slurry hydrocracking zone.

2. The process according to claim 1, wherein the precipitate comprises at least one catalyst, in turn comprising molybdenum sulfide or nickel sulfide.

3. The process according to claim 1, wherein the precipitate comprises at least one catalyst, in turn comprising at least one iron sulfide.

4. The process according to claim 1, wherein the solvent comprises a viscosity reducing agent.

5. The process according to claim 4, wherein the viscosity reducing agent comprises a light cycle oil, a heavy reformate, toluene, benzene, and one or more same or different xylenes.

6. The process according to claim 1, further comprising drying the precipitate to obtain dried solids and a residual solvent.

7. The process according to claim 1, wherein separating comprises centrifuging the mixture to obtain the supernate and precipitate.

8. The process according to claim 6, wherein the drying comprises passing the precipitate to an indirect fired rotary kiln.

9. The process according to claim 8, wherein the drying occurs at a temperature of about 350-about 550° C.

10. The process according to claim 1, wherein a solvent to neat pitch mass ratio is about 3:1-about 1:3.

11. The process according to claim 1, wherein a solvent to neat pitch mass ratio is about 2:1-about 1:2.

12. The process according to claim 1, wherein the slurry hydrocracking zone comprises a slurry hydrocracking reactor.

13. The process according to claim 12, further comprising providing a feed comprising at least one of a vacuum residue and a fluid catalytic cracking slurry oil to the slurry hydrocracking reactor.

14. The process according to claim 13, wherein the deashed pitch is combined with the feed.

15. The process according to claim 13, wherein the slurry hydrocracking reactor operates at a temperature of about 340-about 600° C., a hydrogen partial pressure of about 3.5-about 10.5 MPa, and a space velocity of about 0.1-about 30 volumes of the feed per hour per slurry hydrocarbon reactor volume.

16. A process for recycling a deashed pitch to a slurry hydrocracking zone, comprising:

A) passing a feed to a slurry hydrocracking reactor;

B) obtaining a neat pitch from the slurry hydrocracking reactor;

C) sending the neat pitch to a mixing tank;

D) adding a solvent to the neat pitch to form a mixture;

E) passing the mixture to a centrifuge;

F) separating the deashed pitch;

G) passing the separated deashed pitch to a fractionator to segregate a solvent; and H) passing the deashed pitch from the fractionator to the feed.

17. The process according to claim 16, wherein the deashed pitch comprises one or more $C25^+$ hydrocarbons.

18. The process according to claim 16, further comprising recycling the solvent from the fractionator to the mixing tank.

19. The process according to claim 16, further comprising obtaining a precipitate from the centrifuge and passing the precipitate to an indirect fired rotary kiln.

20. An apparatus for recycling a deashed pitch, comprising:

A) a slurry hydrocracking reactor;

B) a mixing tank in communication with the slurry hydrocracking reactor to receive a neat pitch;

C) a centrifuge in communication with the mixing tank to receive a mixture from the mixing tank; and D) a fractionator in communication with the centrifuge to receive a supernate separated from a precipitate;

wherein the fractionator is in communication with the slurry hydrocracking reactor to provide the deashed pitch from the fractionator.

* * * * *